US007563072B1

(12) United States Patent
Liang

(10) Patent No.: US 7,563,072 B1
(45) Date of Patent: Jul. 21, 2009

(54) TURBINE AIRFOIL WITH NEAR-WALL SPIRAL FLOW COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 343 days.

(21) Appl. No.: 11/527,308

(22) Filed: Sep. 25, 2006

(51) Int. Cl.
*F01D 5/08* (2006.01)
*F01D 5/18* (2006.01)

(52) U.S. Cl. ..... 416/96 A; 415/115

(58) Field of Classification Search ..... 416/96 A, 416/96 R, 97 A, 97 R; 415/115
See application file for complete search history.

(56) References Cited

U.S. PATENT DOCUMENTS 2,864,405 A * 12/1958 Young ..... 138/38
3,806,274 A 4/1974 Moore
4,080,095 A 3/1978 Stahl
4,118,145 A 10/1978 Stahl
4,407,632 A 10/1983 Liang
4,529,357 A 7/1985 Holland
4,684,322 A * 8/1987 Clifford et al. ..... 416/95
5,002,460 A * 3/1991 Lee et al. ..... 416/96 A
5,370,499 A * 12/1994 Lee ..... 416/97 R
5,690,472 A * 11/1997 Lee ..... 416/97 R
5,702,232 A 12/1997 Moore
5,704,763 A * 1/1998 Lee ..... 416/96 R
5,993,156 A * 11/1999 Bailly et al. ..... 416/96 A
6,164,912 A 12/2000 Tabbita et al.
6,254,334 B1 * 7/2001 LaFleur ..... 415/115
6,402,470 B1 * 6/2002 Kvasnak et al. ..... 416/97 R
6,644,921 B2 11/2003 Bunker et al.
6,808,367 B1 10/2004 Liang
6,955,525 B2 10/2005 Liang

* cited by examiner

*Primary Examiner*—Igor Kershteyn
(74) *Attorney, Agent, or Firm*—John Ryznic

(57) ABSTRACT

A turbine blade with a plurality of spiral flow cooling channels spaced along the walls of the blade. Each spiral flow cooling circuit includes two adjacent channels that twist about each other in a radial direction of the blade to form a spiral flow path. The two spiral flow channels meet at intersections such that the flows mix and produce turbulence in the flows. Two adjacent spiral flow channels intersect at a plurality of intersections spaced along the radial direction of the blade. The channels include trip strips arranged in a spiral shape within the channels to promote turbulent flow. A plurality of the spiral flow channels are arranged along the pressure side and suction side of the blade to provide near wall cooling.

4 Claims, 2 Drawing Sheets

TURBINE AIRFOIL WITH NEAR-WALL SPIRAL FLOW COOLING CIRCUIT

BACKGROUND OF THE INVENTION

1. Field of the Invention

The present invention relates generally to fluid reaction surfaces and more specifically to air cooled turbine airfoils.

2. Description of the Related Art Including Information Disclosed Under 37 CFR 1.97 and 1.98

In a gas turbine engine, a turbine section with a plurality of stages of stationary vanes or nozzles and rotary blades or buckets receive a hot gas flow from a combustor to produce mechanic power by driving the turbine shaft. The efficiency of the engine can be increased by increasing the hot gas flow through the turbine. However, the turbine materials cannot be used above certain known operating temperatures without being damaged.

In order to allow for turbine parts to operate in conditions above the high temperature material properties will allow, complex air cooling passages have been proposed to cool the vane and blades, especially in the hottest section of the turbine, the first stage immediately downstream from the combustor. Since the cooling air used for cooling the airfoils typically comes from the compressor, the engine efficiency is reduced due to the bleed off air used for cooling. Engine efficiency can also be increased by using maximizing the cooling effect of the air and minimizing the amount of cooling air required.

The prior art airfoil in U.S. Pat. No. 4,529,357 issued to Holland on Jul. 16, 1985 and entitled TURBINE BLADES shows an airfoil cross section having a plurality of radial cooling holes within the wall of the airfoil for cooling the airfoil. This type of cooling passage is one of the least efficient for minimizing the amount of cooling air while maximizing the heat transfer from the airfoil wall to the cooling air. The straight path does not promote much turbulent flow within the cooling air which would increase the convective heat transfer to the cooling air.

An improvement in the Holland, invention above is shown in the U.S. Pat. No. 5,702,232 issued to Moore on Dec. 30, 1997 and entitled COOLED AIRFOILS FOR A GAS TURBINE ENGINE shows an airfoil cross section (FIG. 1) with radial impingement channels 17 spaced along the wall 11 of the airfoil 10, with each channel connected by a metering hole 16 to a cooling supply passage, and each channel having a film cooling hole 18. Cooling air supplied through the supply channel 12 flows through the metering hole 16 for impingement cooling within the radial impingement channels 17, and then out to the airfoil surface through the film cooling holes 18. a showerhead arrangement includes a metering hole 13 connecting the cooling supply channel 12 to a leading edge cavity 14 and film cooling discharge holes 15 spaced along the leading edge. The cooling efficiency of the Moore patent is higher than in the Holland patent. However, in the Moore arrangement the spanwise and chordwise cooling flow control due to airfoil external hot gas temperature and pressure variation is difficult to achieve. In the Moore patent, the spiral flow passages are used in a stationary vane. Applicant's invention is for use in a rotary blade. Rotation of the blade will impart a driving force for the cooling fluid if the spiral passages are in the radial direction as opposed to the chordwise direction in Moore. Also, a single pass radial channel flow is not the best method of utilizing cooling air resulting in low convective cooling effectiveness.

U.S. Pat. No. 4,080,095 issued to Stahl on Mar. 21, 1978 entitled COOLED TURBINE VANE shows a cooled vane with cooling channels having a spiral or twisted arrangement like in a corkscrew-like configuration in which water is passed through for cooling the vane. The spiral shaped cooling passages flow in a chordwise direction of the airfoil and not in a radial direction. Also, the spiral shaped passages do not cross one another such that the two flows will mix.

It is an object of the present invention to provide for a cooling air flow circuit in a turbine airfoil that will provide more cooling using less cooling air than the cited prior art references.

BRIEF SUMMARY OF THE INVENTION

An air cooled turbine airfoil having a near-wall spiral flow cooling circuit in which two cooling passages twist about each other in a radial direction of the airfoil and join paths in order to promote turbulent flow within the spiral paths. Two adjacent spiral shaped cooling air passages extend along the wall in the airfoil radial direction and twist about each other to form a spiral path. The two paths meet and join in order that the flow in one path will cross the flow in the other path and promote turbulent flow. The pressure side and suction side walls of the airfoil include spiral flow passages spaced along the walls to cool the airfoil. The spiral flow cooling circuit generates extremely high turbulent level cooling flow, and therefore generates high heat transfer coefficient values. The spiral flow circuit also yields a very high internal convective cooling effectiveness that is higher than the single pass radial flow channel of the prior art.

DETAILED DESCRIPTION OF THE INVENTION

Figure 1:
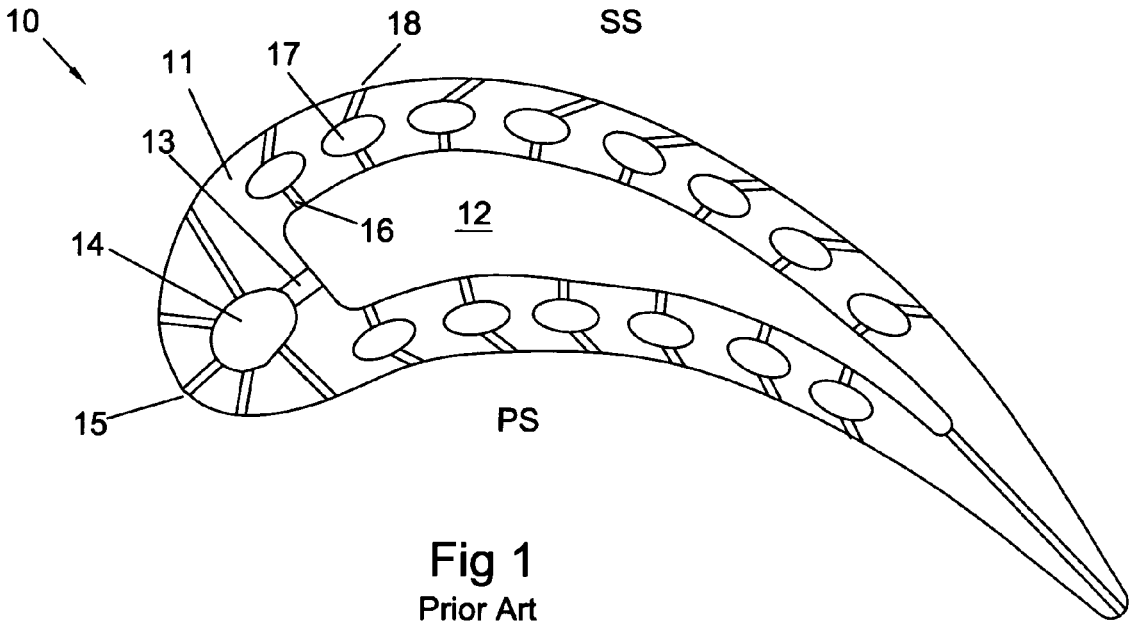
Fig 1 Prior Art
FIG. 1 shows a top view of a cut section of a radial flow cooling circuit for a turbine airfoil of the prior art.
Figure 2:
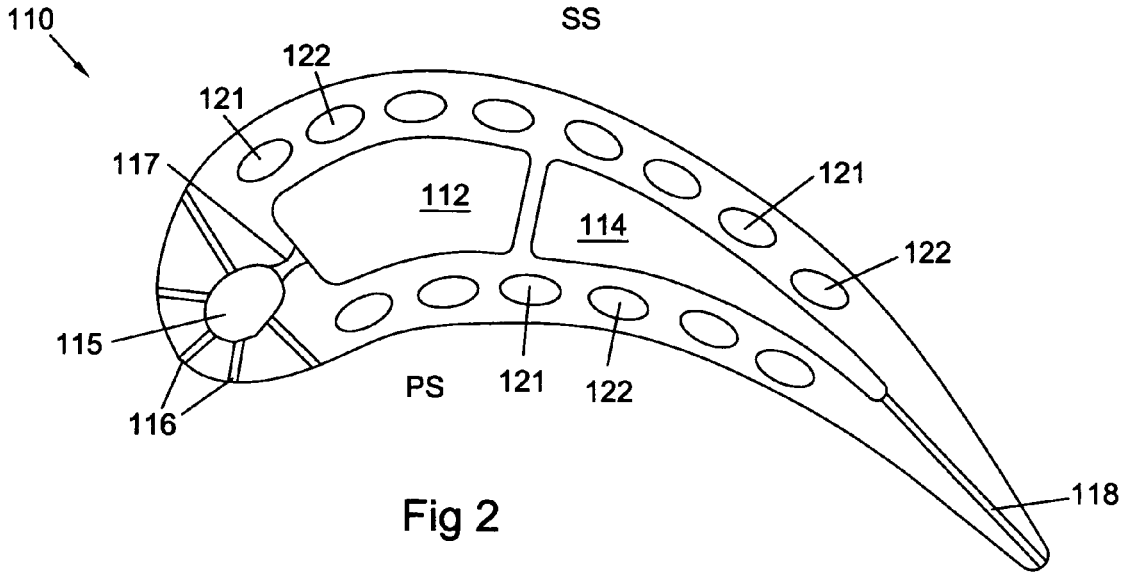
FIG. 2 shows a top view of a cut section of the cooling flow circuit of the present invention.

The present invention is a turbine airfoil, which can be a rotary blade or a stationary nozzle, which includes a cooling flow circuit to cool the airfoil. FIG. 2 shows a top view of a cut-away of the airfoil 110. The airfoil walls form two internal cooling supply passages 112 and 114 that are separated by a rib extending from the pressure side (PS) wall to the suction side (SS) wall. The leading edge is cooled by a well known showerhead arrangement that includes a cooling supply channel 115 connected to the forward cooling supply passage 112 by a metering hole 117, and a plurality of film cooling holes 116 opening onto the leading edge surface of the airfoil. The rearward cooling supply passage 114 supplies cooling air to the trailing edge region through cooling holes 118 spaced along the trailing edge in a radial direction of the airfoil.

Figure 3:
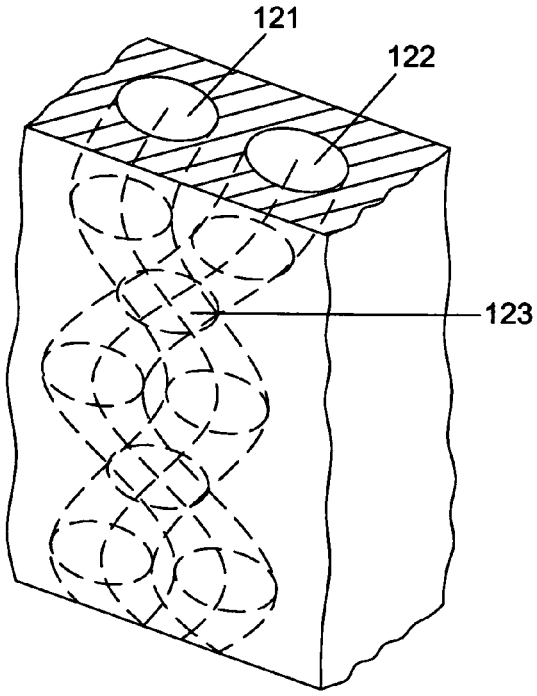
FIG. 3 shows a schematic isometric view of a single spiral flow cooling circuit of the present invention.

Along the side walls of the airfoil are a plurality of spiral flow cooling channels arranged in a general radial direction of the airfoil. The spiral flow channels include a pair of twisted or spiral shaped channels 121 and 122. FIG. 3 shows a schematic view of a pair of spiral shape flow channels 121 and 122. each of the two channels 121 and 122 spiral or twist about each other in the radial direction of the blade such that channel 121 will be nearer to the hot wall surface while channel 122 will be nearer to the cool wall surface, followed by the two channels 121 and 122 joining, and then twisting about such that the channel 121 that was adjacent the hot wall surface is now nearer to the cool wall surface, with the channel 122 opposed to the channel 121. A plurality of these two pair twisted flow cooling channels 121 and 122 are arranged in series along the pressure side and suction side walls of the airfoil as shown in FIG. 2. Each of the spiral flow channels 121 and 122 are supplied with cooling air from a connection to the cooling supply passage below the airfoil platform, and each spiral flow channel 121 and 122 discharges the cooling air out holes on the airfoil tip.

The two spiral flow channels 121 and 122 join paths at an intersection 123 in order to allow for the cooling air flowing in one channel 121 to mix with the cooling air flowing in the other channel 122 and promote turbulence. Downstream from the intersection path 123, the two channels 121 and 122 separate again and spiral around each other until the two paths meet again at another intersection 123. since the spiral channels 121 and 122 are generally in the radial direction of the airfoil, when the airfoil is a rotary blade the rotation of the blade will induce flow in the cooling air through the channels because of the centrifugal force on the cooling air from the rotation. If the spiral flow channels were arranged like that in the Moore patent described above, the cooling flow would not be aided by the rotation of the blade.

Because the wall of the airfoil is not very thick, the spiral channels 121 and 122 are of such small diameter that the channels can twist about between the outer surface and the inner surface of the wall. Each spiral channel 121 and 122 also includes trip strips or other protrusions that will produce turbulent flow in the cooling air in order to increase the heat transfer from the hot wall to the cooling air. In the preferred embodiment, the spiral channels 121 and 122 each include a spiral shaped turbulators that extends along the spiral channel between the intersections 123 or between the intersection 123 and the inlet or outlet of the channel. The spiral turbulators spiral in the direction of the cooling air flow through the channel.

I claim the following:

1. A turbine rotor blade for use in a gas turbine engine, the rotor blade comprising:

an airfoil wall forming an airfoil outer surface and an airfoil inner surface;

a pair of adjacent radial cooling channels within the wall, at least one of the adjacent pair of radial cooling channels twisting about the other channel in a spiral shape;

the two adjacent channels both twist about each other to form a spiral flow path; and, the two adjacent spiral cooling channels joining at an intersection such that the flows mix;

whereby rotation of the rotor blade forces cooling air in the radial cooling channel toward the blade tip.

2. A turbine rotor blade for use in a gas turbine engine, the rotor blade comprising:

an airfoil wall forming an airfoil outer surface and an airfoil inner surface;

a pair of adjacent radial cooling channels within the wall, at least one of the adjacent pair of radial cooling channels twisting about the other channel in a spiral shape; and, the two adjacent cooling channels joining at an intersection such that the flows mix;

whereby rotation of the rotor blade forces cooling air in the radial cooling channel toward the blade tip.

3. A turbine rotor blade of claim 1, and further comprising:

a plurality of spiral flow channels spaced about the pressure side and the suction side of the airfoil.

4. A turbine rotor blade for use in a gas turbine engine, the rotor blade comprising:

an airfoil wall forming an airfoil outer surface and an airfoil inner surface;

a pair of adjacent radial cooling channels within the wall, at least one of the adjacent pair of radial cooling channels twisting about the other channel in a spiral shape; and, the pair of adjacent radial flow channels spiraling about each other in-between a plurality of intersection in which the two channels join such that the flows in the two channels mix;

whereby rotation of the rotor blade forces cooling air in the radial cooling channel toward the blade tip.

* * * * *